US010862226B2

(12) United States Patent
Mochizuki et al.

(10) Patent No.: US 10,862,226 B2
(45) Date of Patent: Dec. 8, 2020

(54) TERMINAL FITTING

(71) Applicant: YAZAKI CORPORATION, Tokyo (JP)

(72) Inventors: Nobuyoshi Mochizuki, Shizuoka (JP); Kouichirou Matsushita, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/560,969

(22) Filed: Sep. 4, 2019

(65) Prior Publication Data

US 2020/0083618 A1 Mar. 12, 2020

(30) Foreign Application Priority Data

Sep. 6, 2018 (JP) ..... 2018-167042

(51) Int. Cl.
*H01R 4/48* (2006.01)
*H01R 4/18* (2006.01)

(52) U.S. Cl.
CPC ..... *H01R 4/4818* (2013.01); *H01R 4/185* (2013.01)

(58) Field of Classification Search
CPC ..... H01R 13/187; H01R 13/11; H01R 13/13; H01R 4/185; H01R 4/4818
See application file for complete search history.

(56) References Cited

U.S. PATENT DOCUMENTS 5,158,485 A 10/1992 Saito et al.
5,271,741 A 12/1993 Saito et al.
5,562,501 A * 10/1996 Kinoshita ..... H01R 13/113 439/852
5,630,738 A * 5/1997 Ito ..... H01R 13/113 439/851
5,730,629 A * 3/1998 Samejima ..... H01R 13/113 29/874
6,152,788 A 11/2000 Hata et al.
6,290,553 B1 * 9/2001 Sato ..... H01R 13/187 439/843
6,478,636 B1 * 11/2002 Makita ..... H01R 13/113 439/852

(Continued)

FOREIGN PATENT DOCUMENTS

JP 1-112574 U 7/1989
JP 3-106667 U 11/1991

(Continued)

*Primary Examiner* — Briggitte R. Hammond
(74) *Attorney, Agent, or Firm* — Kenealy Vaidya LLP

(57) ABSTRACT

A terminal fitting including a cylindrical portion into which a mating terminal is to be inserted; and a contact beam provided inside the cylindrical portion, the contact beam extending toward an insertion direction of the mating terminal into the cylindrical portion, being elastically deformable along a deflection direction of the contact beam and including a protruding portion extending in a direction intersecting the deflection direction, and the cylindrical portion including a peripheral wall and an engagement portion to be engaged with the protruding portion to regulate a movement of the contact beam, the engagement portion including a first portion and a second portion protruding from the peripheral wall of the cylindrical portion toward an inside of the cylindrical portion to regulate the movement of the contact beam in the deflection direction and in the insertion direction respectively.

4 Claims, 7 Drawing Sheets

(56) References Cited

U.S. PATENT DOCUMENTS

| | | | | |
|---|---|---|---|---|
| 6,520,811 | B2 * | 2/2003 | Mitani | H01R 13/113 439/843 |
| 6,527,601 | B2 * | 3/2003 | Chen | H01R 13/187 439/851 |
| 6,547,608 | B2 * | 4/2003 | Sato | H01R 13/11 439/851 |
| 7,294,027 | B1 * | 11/2007 | Tyler | H01R 13/187 439/845 |
| 7,374,465 | B2 * | 5/2008 | Tanaka | H01R 13/113 439/595 |
| 7,419,410 | B2 * | 9/2008 | Myer | H01R 13/113 439/852 |
| 7,503,813 | B1 * | 3/2009 | Osterhart | H01R 13/113 439/852 |
| 7,988,505 | B2 * | 8/2011 | Hotea | H01R 13/187 439/852 |
| 8,333,622 | B2 * | 12/2012 | Blasko | H01R 13/113 439/852 |
| 8,506,328 | B2 * | 8/2013 | Mizutani | H01R 13/113 439/595 |
| 8,858,274 | B2 * | 10/2014 | Jakoplic | H01R 13/11 439/877 |
| 8,974,256 | B2 * | 3/2015 | Okano | H01R 13/11 439/852 |
| 9,184,513 | B2 * | 11/2015 | Tanigawa | H01R 13/11 |
| 9,190,758 | B2 * | 11/2015 | Endo | H01R 13/629 |
| 9,431,723 | B2 * | 8/2016 | Chikusa | H01R 13/113 |
| 10,069,232 | B2 * | 9/2018 | Endo | H01R 13/187 |
| 10,090,608 | B2 * | 10/2018 | Lewis | H01R 13/113 |
| 10,297,940 | B2 * | 5/2019 | Tanikawa | H01R 13/114 |
| 2014/0287635 | A1 * | 9/2014 | Tsuji | H01R 13/113 439/852 |
| 2018/0309217 | A1 | 10/2018 | Enomoto et al. | |
| 2020/0083618 | A1 * | 3/2020 | Mochizuki | H01R 4/4818 |

FOREIGN PATENT DOCUMENTS

| | | | | |
|---|---|---|---|---|
| JP | 2000-215933 | A | | 8/2000 |
| JP | 2014-120484 | A | | 6/2014 |
| JP | 2014-160544 | A | | 9/2014 |
| JP | 2018174076 | A | * | 11/2018 |
| WO | 2017/069076 | A1 | | 4/2017 |

* cited by examiner

FIG. 4A
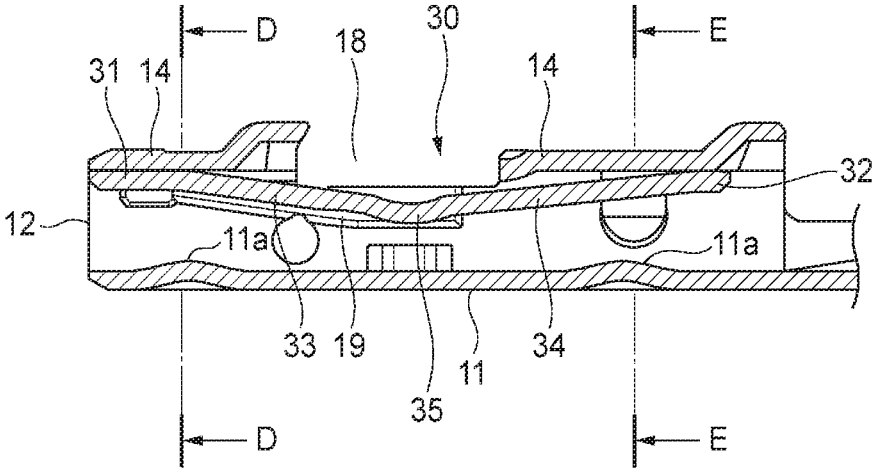
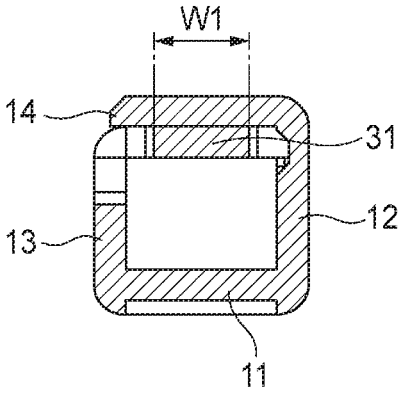
FIG. 4B
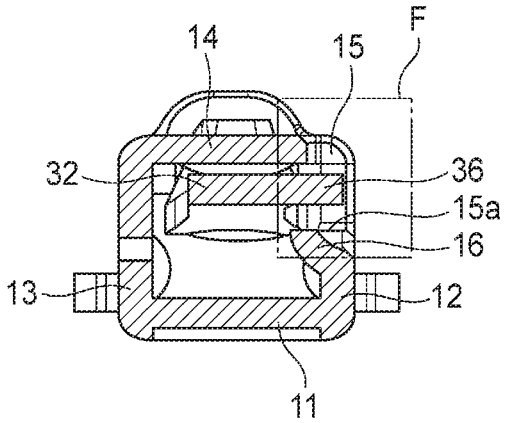
FIG. 4C
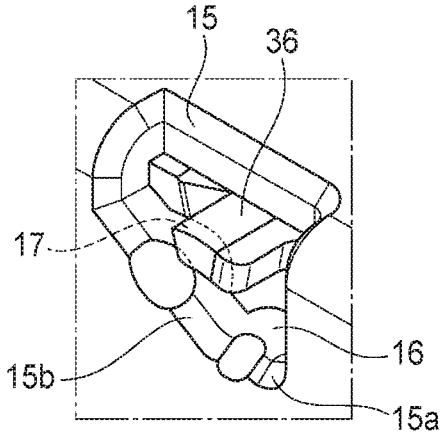
FIG. 4D

TERMINAL FITTING

CROSS-REFERENCE TO RELATED APPLICATION

The present application claims priority to Japanese Patent Application No. 2018-167042 filed on Sep. 6, 2018, the entire content of which is incorporated herein by reference.

TECHNICAL FIELD

The present invention relates to a terminal fitting including a cylindrical portion into which a mating terminal is to be inserted, and a contact beam provided inside the cylindrical portion.

BACKGROUND

In the related art, there is proposed a terminal fitting (for example, a female terminal) including a cylindrical portion into which a mating terminal (for example, a male terminal) is to be inserted and a cantilevered or both-side supported contact beam (for example, a contact spring) provided inside the cylindrical portion. Specifically, one of the terminal fittings in the related art includes a cantilevered contact spring accommodated in a hollow portion of a cylindrical portion, and a mating terminal inserted in the cylindrical portion is sandwiched between peripheral walls of the cylindrical portion so as to be in contact with the contact spring in a pressed manner. Accordingly, for example, an oxide film naturally generated on a surface of the contact spring or the mating terminal is scraped off during insertion of the mating terminal so as to achieve a good electrical connection between the contact spring and the mating terminal (see, e.g., JP2014-120484A).

In recent years, due to a tendency that the number of circuits of an electronic device in which the terminal fitting as described above is used increases, etc., it is desired to further reduce a size of the terminal fitting. However, if a size of the terminal fitting is simply reduced, a size of the contact spring is also to be reduced, and a pressing force of the contact spring with respect to the mating terminal is to be reduced. The size reduction of the contact spring can affect the scraping of the oxide film described above and deformation resistance of the contact spring when an unintended external force is applied to the terminal fitting. Meanwhile, if the contact spring is simply made to be thicker to increase a pressing force thereof, the pressing force applied to the mating terminal is suddenly increased during the insertion of the mating terminal into the cylindrical portion, which may impair the usability of the terminal fitting.

SUMMARY

Illustrative aspects of the present invention provide a terminal fitting whose size can be reduced without impairing the reliability of the electrical connection between the terminal fitting and the mating terminal and the usability of the terminal fitting as much as possible.

According to an illustrative aspect of the present invention, a terminal fitting includes a cylindrical portion into which a mating terminal is to be inserted and a contact beam provided inside the cylindrical portion. The contact beam extends toward an insertion direction in which the mating terminal is to be inserted into the cylindrical portion. The contact beam portion is configured to be elastically deformable along a deflection direction of the contact beam and includes a protruding portion extending in a direction intersecting the deflection direction. The cylindrical portion includes a peripheral wall and an engagement portion configured to be engaged with the protruding portion to regulate a movement of the contact beam, the engagement portion including a first portion protruding from the peripheral wall of the cylindrical portion toward an inside of the cylindrical portion to regulate the movement of the contact beam in the deflection direction, and a second portion protruding from the peripheral wall toward the inside of the cylinder to regulate the movement of the contact beam in the insertion direction.

Other aspects and advantages of the invention will be apparent from the following description, the drawings and the claims.

BRIEF DESCRIPTION OF DRAWINGS

FIG. 4A is a cross-sectional view taken along a line B-B in FIG. 2;

FIG. 4B is a cross-sectional view taken along a line D-D in FIG. 4A;

FIG. 4C is a cross-sectional view taken along a line E-E in FIG. 4A;

FIG. 4D is a detailed view of a portion F;

DESCRIPTION OF EMBODIMENTS

Hereinafter, exemplary embodiments of the present invention will be described in detail with reference to the drawings.

Figure 1:
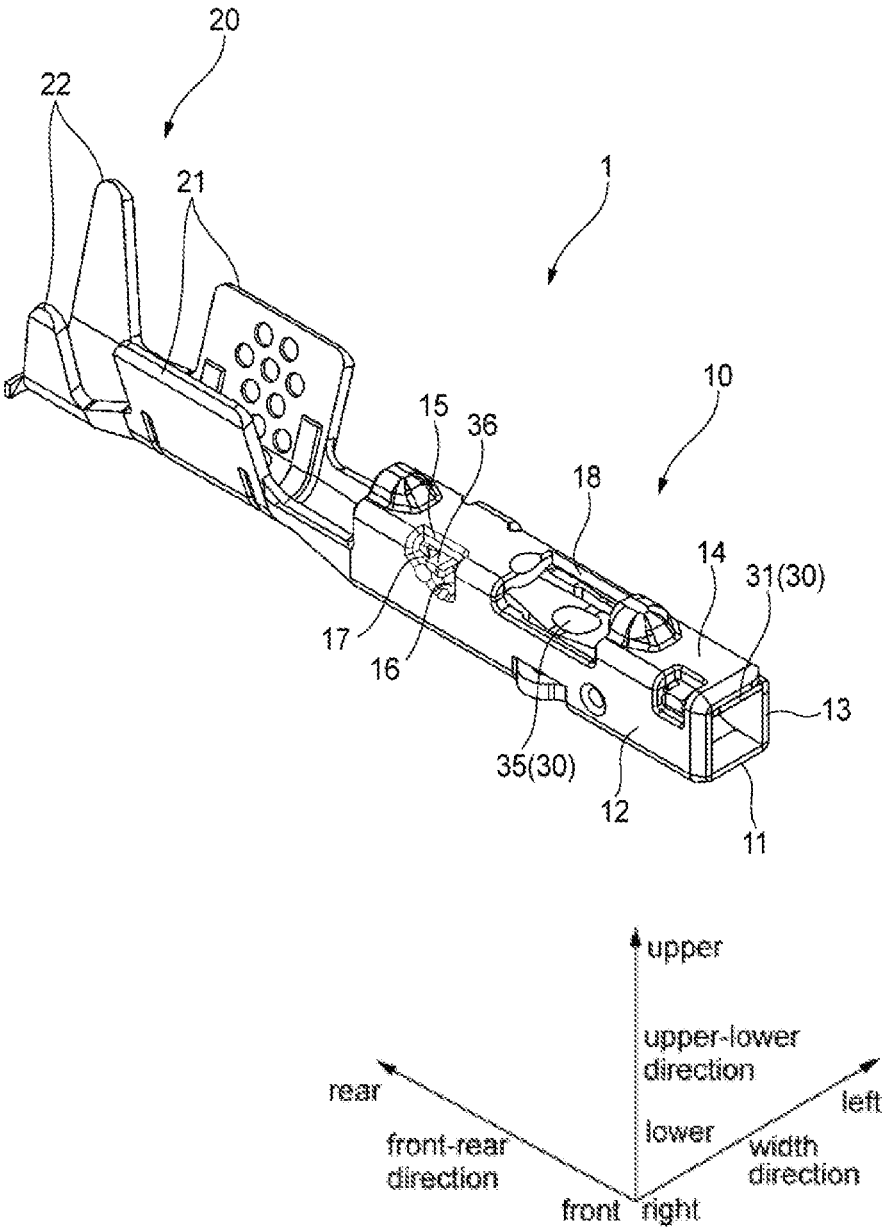
FIG. 1 is a perspective view of a terminal fitting (female terminal) according to an embodiment of the present invention.

As shown in FIGS. 1 to 4D, the female terminal 1 includes a cylindrical portion 10 into which a flat plate-shaped mating terminal 40 (hereinafter, also referred to as "male terminal", with reference to FIGS. 6A to 6C) is to be inserted, a barrel portion 20 which is continuously formed on a rear side of the cylindrical portion 10 and by which a wire is to be crimped, and a contact beam 30 which is formed inside the cylindrical portion 10 and is to press the inserted male terminal 40. In the present embodiment, the female terminal 1 is formed by applying pressing, bending, or the like to one metal plate. Hereinafter, as shown in FIG. 1, direction indicating signs of a "front-rear direction", a "width direction", an "upper-lower direction", "front", "rear". "left", "right", "upper" and "lower" are used for easy description. The "front-rear direction", the "width direction", and the "upper-lower direction" are orthogonal to one another. The "front-rear direction"

corresponds to an "insertion direction" into which the mating terminal 40 is inserted and removed from the female terminal 1.

As shown in FIG. 1, in the present embodiment, the cylindrical portion 10 has a rectangular cylindrical shape extending in the front-rear direction. The cylindrical portion 10 includes a bottom wall 11, a right side wall 12 which is continuously erected upward from a right end edge of the bottom wall 11, a left side wall 13 which is continuously erected upward from a left end edge of the bottom wall 11 and an upper wall 14 which extends leftward continuously from an upper end edge of the right side wall 12.

As shown in FIG. 4A, beads 11*a* which are protrusions extending in the width direction on an inner wall surface of the bottom wall 11 are formed respectively at a position close to a front end portion and a position close to a rear end portion in the front-rear direction of the inner wall surface of the bottom wall 11. The bead 11*a* is recessed on an outer wall surface and is convex in the inner wall surface. Each bead 11*a* has a function of holding the male terminal 40 inserted in the cylindrical portion 10 with the contact beam 30 (with reference to FIGS. 6A to 6C).

As shown in FIG. 1 and FIG. 4D, a through hole 15 extending through a peripheral wall of the cylindrical portion in the width direction is formed at a position close to a rear end portion of the right side wall 12. As described later, a tip projection 36 of the contact beam 30 is to be inserted into the through hole 15, so that the through hole 15 functions as an engagement portion which is engaged with the tip projection 36, and at which a movement of a free end portion 32 of the contact beam 30 is regulated.

An upper edge of the through hole 15 is positioned along a boundary between the right side wall 12 and the upper wall 14. A lower edge of the through hole 15 is constituted by a parallel edge 15*a* which extends in the front-rear direction and constitutes a front portion thereof, and an inclined edge 15*b* which extends obliquely upward and rearward from a rear end of the parallel edge 15*a*.

As shown in FIG. 4D, a first projection 16 protruding toward an inside of the cylindrical portion 10 is formed (also with reference to FIG. 4C) on the parallel edge 15*a*, and a second projection 17 protruding toward the inside of the cylindrical portion 10 is formed on the inclined edge 15*b*. Functions of the first projection 16 and the second projection 17 are to be described later.

Figure 3A:
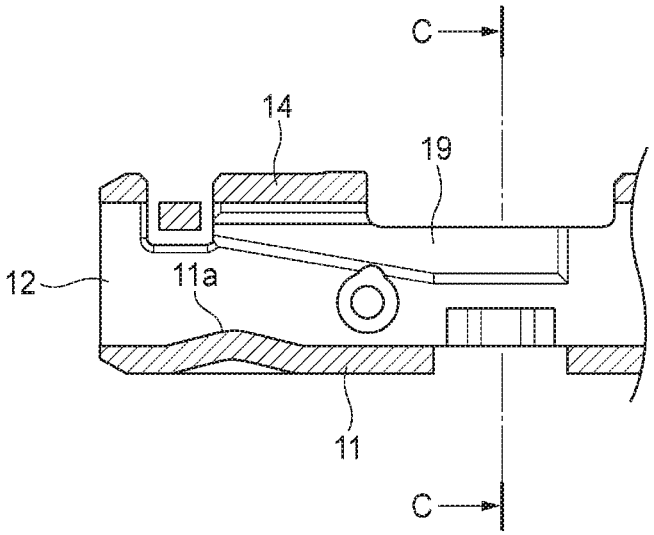
FIG. 3A is a cross-sectional view taken along a line A-A in FIG. 2.
Figure 3B:
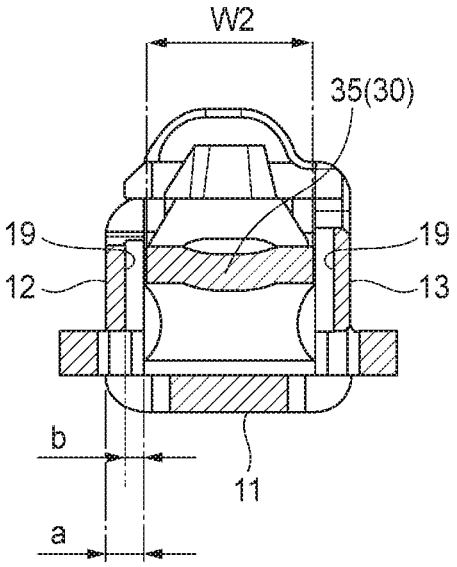
FIG. 3B is a cross-sectional view taken along a line C-C in FIG. 3A.

As shown in FIG. 1 and FIGS. 4A to 4D, a rectangular opening 18 is formed at a central position in the front-rear direction of the upper wall 14. An indented portion 35 (to be described later) of the contact beam 30 is exposed from the opening 18. As shown in FIGS. 3A and 3B, thickness reduced portions 19 whose thickness is thinner than a thickness a of a portion of the peripheral wall surrounding the thickness reduced portion by a thickness b with inner wall surfaces being recessed in a thickness direction of the peripheral wall are formed respectively on the right side wall 12 and the left side wall 13. The thickness reduced portion 19 is formed in a region which extends in the front-rear direction and corresponds to an extension region of a flat plate portion 33 of the contact beam 30, which is to be described later (also refer to FIGS. 4A to 4D).

The barrel portion 20 includes a pair of core wire crimping pieces 21 disposed adjacent to a rear side of a rear end of the cylindrical portion 10, and a pair of covering crimping pieces 22 disposed adjacent to a rear side of the pair of core wire crimping pieces 21. The pair of core wire crimping pieces 21 are portions for crimping and fixing an exposed core wire by removing a covering on a tip end portion of the electric wire to be connected to the female terminal 1. The pair of covering crimping pieces 22 are portions for crimping and fixing the covering on the tip end portion of the electric wire to be connected to the female terminal 1.

Figure 2:
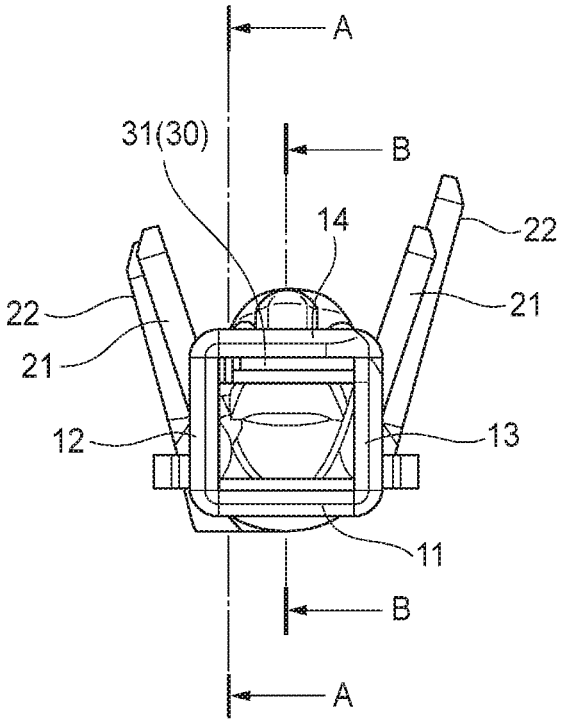
FIG. 2 is a front view of the terminal fitting.

As shown in FIGS. 4A to 4D, the contact beam 30 is a cantilevered plate spring portion which is positioned close to the upper wall 14 inside the cylindrical portion 10, and extends from a fixed end portion 31 to a free end portion 32 positioned rearward of the fixed end portion 31. As shown in FIGS. 1 and 2, the fixed end portion 31 is a flat plate-shaped portion continuously extending rightward from an upper end edge of the front end portion of the left side wall 13 of the cylindrical portion 10. The fixed end portion 31 is fixed to the front end portion of the left side wall 13. As can be understood from FIG. 4A, the contact beam 30 is elastically deformable so as to press an upper surface of the male terminal 40 inserted in the cylindrical portion 10 downward toward the bead 11*a*.

The contact beam 30 includes a flat plate portion 33 extending rearward and slightly downward from the fixed end portion 31, a flat plate portion 34 extending forward and slightly downward from the free end portion 32, and an indent portion 35 which connects the flat plate portion 33 and the flat plate portion 34 in the front-rear direction and protrudes downward so as to have a curved surface shape (that is, convex downward). A top of the indent portion 35 is positioned to be lowermost in the contact beam 30. A boundary between the flat plate portion 33 and the indent portion 35 and a boundary between the flat plate portion 34 and the indent portion 35 are connected by smooth curved surfaces which are convex on an outer surface.

As shown in FIG. 4A, the flat plate portion 33 and the indent portion 35 of the contact beam 30 extend in the front-rear direction along the thickness reduced portions 19 of the right side wall 12 and the left side wall 13. Therefore, a width dimension W2 (with reference to FIG. 3B) of the flat plate portion 33 and the indent portion 35 of the contact beam 30 is larger than a width dimension W1 (with reference to FIG. 4B) of the fixed end portion 31 of the contact beam 30 by a width by which inner surfaces of the right side wall 12 and the left side wall 13 are recessed. As a result, the pressing force of the contact beam 30 with respect to the male terminal 40 can be increased while the size in outer shape of the terminal fitting 1 is reduced.

The tip projection 36 protruding outward in the width direction is formed on a right side edge of the free end portion 32 of the contact beam 30. As shown in FIG. 1 and FIGS. 4C and 4D, the tip projection 36 is inserted into the through hole 15 of the right side wall 12 of the cylindrical portion 10. In a state where no external force is applied to the contact beam 30, as shown in FIG. 4D, the tip projection 36 is not abutted on any of the edges of the through holes 15.

A tip end of the tip projection 36 is positioned in an inner side (left side) in the width direction of an outer surface of the right side wall 12 of the cylindrical portion 10 (with reference to FIG. 4C). Therefore, for example, in a case where the terminal fitting 1 is to be accommodated in a terminal accommodating chamber of a connector housing, or the like, a wall surface of the terminal accommodating chamber and a seal member for waterproof provided in the terminal accommodating chamber can be protected from being touched and thereby damaged by the tip projection 36.

In this way, the tip projection 36 is inserted into the through hole 15, and thus the movement of the free end portion 32 of the contact beam 30 is regulated. Advantages of the above will be described below. First, as shown in FIG.

5, a case where an unintended downward external force is applied to the contact beam 30 will be described.

In this case, the tip projection 36 is butted on the parallel edge 15*a* of the through hole 15 (specifically, the first projection 16) even if the contact beam 30 moves up and down, so that a downward movement of the contact beam 30 is regulated and the extent of deformation of the contact beam 30 can be controlled. Particularly, since the parallel edge 15*a* includes the first projection 16 which protrudes from the peripheral wall of the cylindrical portion 10 toward inside the cylinder, an engaging width between the tip projection 36 and the parallel edge 15*a* is increased. Therefore, as compared with a case where the parallel edge 15*a* does not include the first projection 16, the movement of the contact beam 30 can be regulated more with more certainty. Similarly, in this case, the tip projection 36 is butted on the inclined edge 15*b* of the through hole 15 (specifically, the second projection 17) even if the contact beam 30 moves in the front-rear direction, so that a rearward movement of the contact beam 30 is regulated and the extent of deformation of the contact beam 30 can be controlled. An engaging width between the tip projection 36 and the inclined edge 15*b* is also as large as described above. Thus, the movements of the contact beam 30 in the front-rear direction and the upper-lower direction can be regulated with more certainty, and deformation resistance of the contact beam 30 against an external force can be enhanced.

Figure 6A:
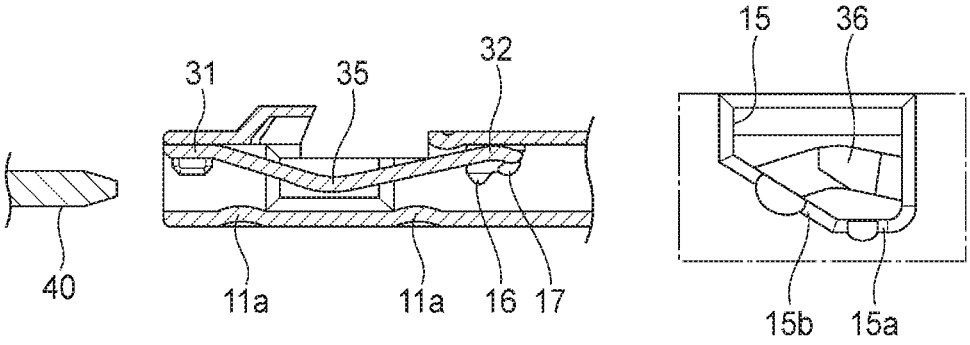
FIGS. 6A to 6C are views showing transition of operation when a mating terminal (male terminal) is inserted into a cylindrical portion.
Figure 6B:
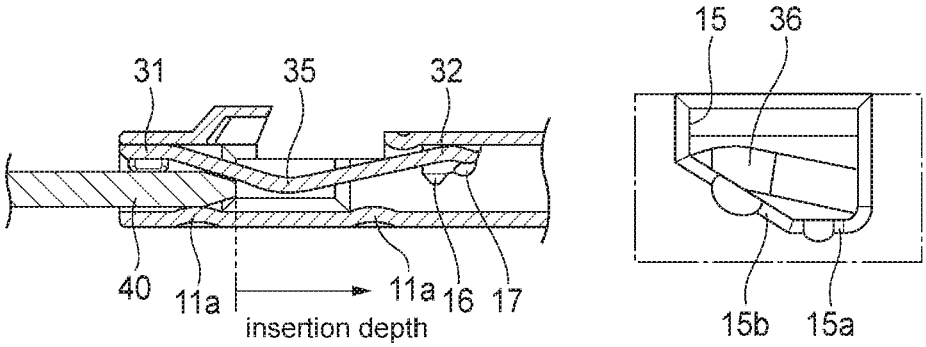
Figure 6C:
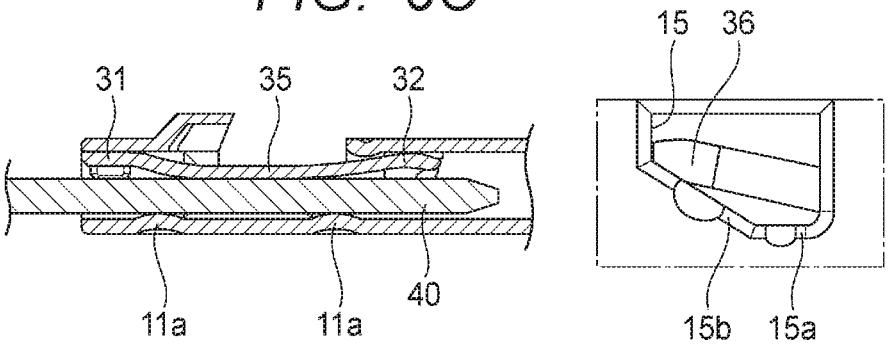
Figure 7:
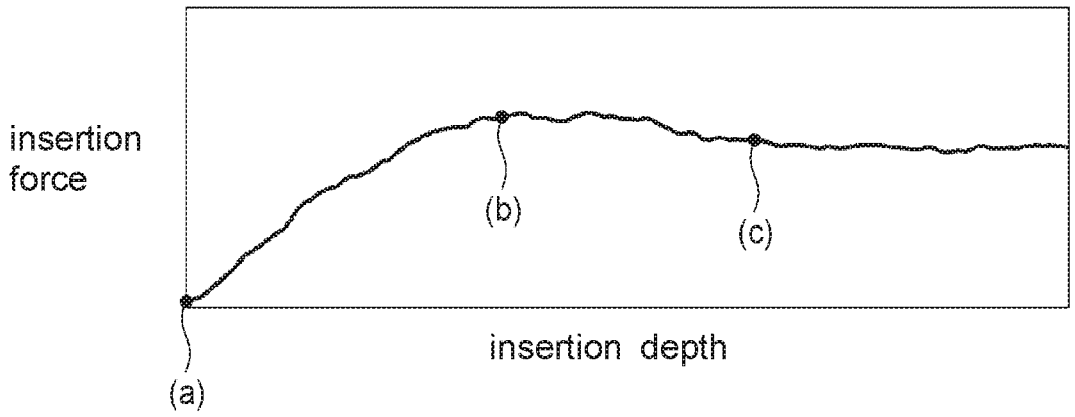
FIG. 7 is a graph showing transition of an insertion force with respect to an insertion depth when the mating terminal (male terminal) is inserted into the cylindrical portion.

Next, as shown in FIGS. 6A to 6C, a case where the male terminal 40 is inserted into the cylindrical portion 10 will be described. FIG. 7 shows transition of an insertion force of the male terminal 40 (that is, a force required to insert the male terminal 40 into the cylindrical portion 10) with respect to an insertion depth of the male terminal 40. In FIG. 7, an insertion depth represents a backward movement distance of the male terminal 40 after the male terminal 40 starts contacting the contact beam 30.

As shown in FIG. 6A, since no external force is applied to the contact beam 30 at a stage before the male terminal 40 is inserted, the tip projection 36 is not in contact with any of the edges of the through hole 15.

When the male terminal 40 starts contact with the contact beam 30 (more specifically, the flat plate portion 33) (corresponding to a point (a) in FIG. 7) from this state, the contact beam 30 is deformed to extend rearward. The insertion force is also gradually increased as the deformation extending rearward of the contact beam 30 (with reference to a process from point (a) to point (b) in FIG. 7).

As the deformation progresses, the tip projection 36 is eventually abutted on the inclined edge 15*b* (specifically, the second projection 17) of the through hole 15 (corresponding to point (b) in FIG. 7) as shown in FIG. 6B. After the tip projection 36 is abutted on the inclined edge 15*b*, as shown in FIG. 6C, the tip projection 36 slides on the inclined edge 15*b* so as to move along the inclined edge 15*b* according to further deformation extending rearward of the contact beam 30. Therefore, as compared with a case where the tip projection 36 cannot move on the inclined edge 15*b*, a sudden increase in insertion force can be prevented (with reference to a process from point (h) to point (c) in FIG. 7). As a result, as shown in FIG. 7, in the entire process from the insertion start to the insertion completion of the male terminal 40, the insertion force is not increased suddenly.

Since the inclined edge 15*b* includes the second projection 17 which protrudes from the peripheral wall of the cylindrical portion 10 toward inside the cylinder, an engaging width between the tip projection 36 and the inclined edge 15*b* is increased. Therefore, as compared with a case where the inclined edge 15*b* does not include the second projection 17, the movement of the tip projection 36 along the inclined edge 15*b* can be maintained more properly.

As described above, according to the female terminal 1 of the present embodiment of the invention, the tip projection 36 provided on the contact beam 30 of the terminal fitting 1 is engaged with the through hole 15 provided in the cylindrical portion 10, so that the movement of the contact beam 30 is regulated. Therefore, as compared with a case where the contact beam 30 has a simple cantilevered shape and the movement of the contact beam 30 is not regulated, the pressing force of the contact beam 30 on the male terminal 40 is increased. Even in a case where an unintended external force is applied to the terminal fitting 1, the movement of the contact beam 30 is regulated and the extent of deformation of the contact beam 30 can be controlled. Particularly, since the through hole 15 includes the first projection 16 and the second projection 17 which protrude from the peripheral wall of the cylindrical portion 10 toward inside the cylinder, the engaging width between the tip projection 36 of the contact beam 30 the first projection 16 and the engaging width between the tip projection 36 and the second projection 17 are increased. Therefore, as compared with a case where the through hole 15 does not include such protrusions, the movement of the contact beam 30 can be regulated more with more certainty.

Further, according to the female terminal 1, the tip projection 36 is disposed so as not to protrude out of an outer surface of the peripheral wall of the cylindrical portion 10. Therefore, for example, in a case where the terminal fitting 1 is accommodated in a terminal accommodating chamber of a connector housing, or the like, a wall surface of the terminal accommodating chamber and a seal member for waterproof provided in the terminal accommodating chamber can be protected from being touched and thereby damaged by the tip projection 36.

Further, according to the female terminal 1, projections (that is, the first projection 16 and the second projection 17) for being engaged with the tip projection 36 of the contact beam 30 are provided on edge portions of the through hole 15. Particularly, a projection (second projection 17) is provided on the inclined edge 15*b* extending in a direction inclined with respect to the insertion direction of the male terminal 40, so that the tip projection 36 in contact with the inclined edge 15*b* moves along the inclined edge 15*b* when the contact beam 30 contacting with the male terminal 40 in a pressed manner is deformed to extend in the insertion direction. Therefore, as compared with a case where the tip projection 36 cannot move on the inclined edge 15*b*, the insertion force can be prevented from being increased rapidly.

Further, according to the female terminal 1, the contact beam 30 extends along the thickness reduced portions 19 provided on the peripheral wall of the cylindrical portion 10. Then, the width of the contact beam 30 (particularly, the flat plate portion 33 and the indent portion 35) can be increased by a width by which inner surfaces of the peripheral walls of the thickness reduced portions 19 are recessed. Therefore, the pressing force of the contact beam against the male terminal 40 can be increased while the size in outer shape of the terminal fitting 1 is reduced.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

For example, in the above embodiment, the tip projection 36 and the through hole 15 are formed only on the right side of the female terminal 1. However, the tip projection 36 and the through hole 15 may be formed on both sides of the female terminal 1.

In the above embodiment, the tip projection 36 extends from the free end portion 32 of the contact beam 30. However, the tip projection 36 may be provided to extend from any position between the fixed end portion 31 and the free end portion 32 of the contact beam 30.

Figure 5:
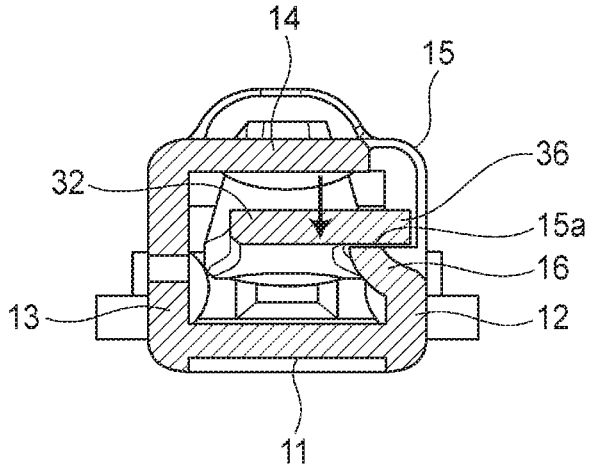
FIG. 5 is a view corresponding to FIG. 4C showing a state where a first projection regulates a downward movement of a free end portion (tip projection) of a contact beam.

In the above embodiment, the parallel edge 15*a* extending in the front-rear direction (that is, the insertion direction) is provided on the lower edge of the through hole 15. However, for example, the parallel edge 15*a* may be provided to extend in a direction inclined with respect to the insertion direction. In the above embodiment, the inclined edge 15*b* is provided to extend obliquely upward and rearward from the rear end of the parallel edge 15*a*. However, for example, the inclined edge 15*b* may be provided to extend obliquely downward from the upper edge of the through hole 15. Thus, the parallel edge 15*a* and the inclined edge 15*b* may be in various forms as long as the movement of the contact beam 30 can be regulated as described above (with reference to FIGS. 5 to 7).

According to the exemplary embodiments described above, a terminal fitting (1) includes a cylindrical portion (10) into which a mating terminal (40) is to be inserted; and a contact beam (30) provided inside the cylindrical portion (10). The contact beam (30) extends toward an insertion direction in which the mating terminal is to be inserted into the cylindrical portion, is elastically deformable along a deflection direction of the contact beam and includes a protruding portion (36) extending in a direction intersecting the deflection direction. The cylindrical portion (10) includes a peripheral wall and an engagement portion (15) configured to be engaged with the protruding portion (36) to regulate a movement of the contact beam (30), the engagement portion (15) including a first portion (16) protruding from the peripheral wall of the cylindrical portion (10) toward an inside of the cylindrical portion to regulate the movement of the contact beam (30) in the deflection direction, and a second portion (17) protruding from the peripheral wall toward the inside of the cylinder to regulate the movement of the contact beam (30) in the insertion direction.

According to this configuration, the protruding portion provided on the contact beam of the terminal fitting is engaged with the engagement portion provided in the cylindrical portion, so that the movement of the contact beam is regulated. Therefore, as compared with a case where the contact beam has a simple cantilevered shape and the movement of the contact beam is not regulated, the pressing force of the contact beam with respect to the mating terminal is increased. Even in a case where an unintended external force is applied to the terminal fitting, the movement of the contact beam is regulated and the extent of deformation of the contact beam can be controlled. Particularly, since the first portion of the engagement portion protrudes from the peripheral wall of the cylindrical portion toward inside the cylinder, the engaging width between the protruding portion of the contact beam and the first portion is increased. The same applies to the second portion. Therefore, as compared with a case where the engagement portion does not include such a protruding shape, the movement of the contact beam can be regulated more with more certainty. By appropriately setting a regulation range of the movement of the contact beam, a sudden increase in insertion force can be prevented. A specific regulation range of the movement of the contact beam may be appropriately determined in consideration of a shape of the terminal fitting, a pressing force required for the terminal fitting, deformation resistance of the contact beam, or the like.

The protruding portion (36) of the contact beam (30) may be disposed so as not to protrude out of an outer surface of the peripheral wall of the cylindrical portion (10).

According to this configuration, the protruding portion is disposed so as not to protrude out of an outer surface of the peripheral wall of the cylindrical portion. Therefore, for example, in a case where the terminal fitting is accommodated in a terminal accommodating chamber of a connector housing, or the like, a wall surface of the terminal accommodating chamber and a seal member for waterproof provided in the terminal accommodating chamber can be protected from being touched and thereby damaged by the tip projection 36.

The engagement portion of the cylindrical portion (10) may include a through hole (15) extending through the peripheral wall of the cylindrical portion (10) in a thickness direction of the peripheral wall, and the first portion (16) defining a first edge (15*a*) of the through hole, and the second portion (17) defining a second edge (15*b*) of the through hole, the second edge extending in a direction inclined with respect to the insertion direction without being orthogonal to the insertion direction.

According to this configuration, projections (that is, the first portion and the second portion) for being engaged with the protruding portion of the contact beam are provided at edge portions of the through hole. Particularly, a projection (that is, the second portion) for engagement is provided on the second edge extending in a direction inclined with respect to the insertion direction of the mating terminal, so that the protruding portion in contact with the second edge slides along the second edge when the contact beam contacting the mating terminal in a pressed manner is deformed to extend toward the insertion direction. Therefore, as compared with a case where the protruding portion is configured not to slide on the second edge, such as when the second edge is orthogonal to the insertion direction, a sudden increase in insertion force can be prevented.

The peripheral wall of the cylindrical portion (10) may include a thickness reduced portion (19) having an inner surface recessed in the thickness direction of the peripheral wall such that the thickness reduced portion has a smaller thickness than a portion of the peripheral wall surrounding the thickness reduced portion, and the contact beam (30) may be configured to extend along the thickness reduced portion (19) in the insertion direction.

According to this configuration, the contact beam extends along the thickness reduced portions provided on the peripheral wall of the cylindrical portion. The width of the contact beam along the thickness reduced portions can be increased by a width by which the inner surfaces of the peripheral walls are recessed. In other words, the elastic modulus of the contact beam can be increased by increasing a cross-sectional area of the contact beam. Therefore, the pressing force of the contact beam with respect to the mating terminal can be increased while the size in outer shape of the terminal fitting 1 is reduced.

What is claimed is:

1. A terminal fitting comprising:

a cylindrical portion into which a mating terminal is to be inserted; and a contact beam provided inside the cylindrical portion;

wherein the contact beam extends toward an insertion direction in which the mating terminal is to be inserted into the cylindrical portion, and the contact beam is configured to be elastically deformable along a deflection direction of the contact beam, the contact beam comprising a protruding portion extending in a direction intersecting the deflection direction, and wherein the cylindrical portion comprises a peripheral wall and an engagement portion configured to be engaged with the protruding portion to regulate a movement of the contact beam, the engagement portion comprising a first portion protruding from the peripheral wall of the cylindrical portion toward an inside of the cylindrical portion to regulate the movement of the contact beam in the deflection direction, and a second portion protruding from the peripheral wall toward the inside of the cylinder to regulate the movement of the contact beam in the insertion direction.

2. The terminal fitting according to claim 1, wherein the protruding portion of the contact beam is disposed so as not to protrude out of an outer surface of the peripheral wall of the cylindrical portion.

3. The terminal fitting according to claim 1, wherein the engagement portion of the cylindrical portion comprises a through hole extending through the peripheral wall of the cylindrical portion in a thickness direction of the peripheral wall, and wherein the first portion defines a first edge of the through hole, and the second portion defines a second edge of the through hole, the second edge extending in a direction inclined with respect to the insertion direction without being orthogonal to the insertion direction.

4. The terminal fitting according to any one of claim 1, wherein the peripheral wall of the cylindrical portion comprises a thickness reduced portion having an inner surface recessed in a thickness direction of the peripheral wall such that the thickness reduced portion has a smaller thickness than a portion of the peripheral wall surrounding the thickness reduced portion, and wherein the contact beam is configured to extend along the thickness reduced portion in the insertion direction.

* * * * *